US006637869B2

(12) United States Patent
Seto

(10) Patent No.: US 6,637,869 B2
(45) Date of Patent: Oct. 28, 2003

(54) INK JET TYPE PRINTER HEAD

(75) Inventor: Shinji Seto, Tokyo (JP)

(73) Assignee: Fuji Xerox Co. Ltd (JP)

( * ) Notice: Subject to any disclaimer, the term of this patent is extended or adjusted under 35 U.S.C. 154(b) by 0 days.

(21) Appl. No.: 09/892,136

(22) Filed: Jun. 26, 2001

(65) Prior Publication Data

US 2001/0055051 A1 Dec. 27, 2001

(30) Foreign Application Priority Data

Jun. 26, 2000 (JP) ..... 2000-191190

(51) Int. Cl.[7] ..... B41J 2/045
(52) U.S. Cl. ..... 347/70
(58) Field of Search ..... 347/68, 69, 70, 347/71; 29/25.35

(56) References Cited

U.S. PATENT DOCUMENTS 5,764,255 A * 6/1998 Tsurui et al. ..... 347/70
6,109,738 A * 8/2000 Miyata et al. ..... 347/71
6,134,761 A * 10/2000 Usui ..... 29/25.35
6,447,106 B1 * 9/2002 Watanabe et al. ..... 347/70

FOREIGN PATENT DOCUMENTS

JP 1269546 10/1989
JP 292644 4/1990

OTHER PUBLICATIONS

"New MACH type ink jet head" published at First Study Meeting in 1996 by Imaging Society of Japan.

* cited by examiner

*Primary Examiner*—Anh T. N. Vo
(74) *Attorney, Agent, or Firm*—Dickstein, Shapiro, Morin & Oshinsky, LLP.

(57) ABSTRACT

An ink jet type printer head is provided which can be simply assembled and in which malfunctions such as leak of ink, peeling-off of members or the like making up the ink jet type printer head are reduced. Grooves going around along a corresponding position inside a space portion of each of pressure chambers are formed on a surface of one piece of a piezoelectric element plate to partition the piezoelectric element plate and each portion of the piezoelectric element plates partitioned by these grooves acts as a piezoelectric element for each of the pressure chambers. Since a non-moving section having the same thickness as that of the piezoelectric elements among piezoelectric elements is formed, a vibrating plate can be firmly fixed to pressure chamber plate containing a partitioning wall portion between pressure chambers.

20 Claims, 11 Drawing Sheets

INK JET TYPE PRINTER HEAD

BACKGROUND OF THE INVENTION

1. Field of the Invention

The present invention relates to an ink jet type printer head and more particularly to an improvement to implement firm fixation of piezoelectric elements and a vibrating plate in the ink jet type printer head in which ink is jetted from a nozzle and the ink is fed from an ink pool by stacking the piezoelectric elements on a pressure chamber plate on which a plurality of pressure chambers each communicating with the nozzle and the ink pool is formed by boring holes and by individually changing a volume of each of the pressure chambers.

The present application claims priority of Japanese Patent Application No.2000-191190 filed on Jun. 26, 2001, which is hereby incorporated by reference.

2. Description of the Related Art

In recent years, attention is focusing on non-impact type printers because they can be operated at a low noise level during printing and because they can provide high speed printing. Among them, an ink jet type printer in particular attracts interest of users, which performs printing of characters, graphics, photographs or a like by jetting ink drops in a liquid state from a printer head to cause the ink drops to adhere to printing paper and which enables high speed printing and printing on ordinary paper, without special fixing processing. Thanks to these advantages, a variety of ink jet type printers are proposed and put into commercial production.

FIG. 6 to FIG. 10*c* show operations in a conventional ink jet type printer head in which jetting of ink and replenishing with ink are achieved by changing a volume of a pressure chamber using expansion/contraction deformation effects (uni-morph mode) of piezoelectric elements.

FIG. 6 is a conceptual diagram showing assembly of the conventional ink jet type printer head. The conventional ink jet type printer head is configured by stacking and bonding a nozzle plate 100 having a nozzle 101 for jetting ink, an ink pool plate 200 in which an ink pool (reservoir) 201 is formed, an ink feeding plate 300 in which ink feeding ports 301 are formed, a pressure chamber plate 400 in which a pressure chamber 401 is formed as through holes, a vibrating plate 500 and piezoelectric elements 600. An ink communicating section 700 is used to communicate the nozzle 101 with the pressure chamber 401. The ink communicating section 700 is provided commonly to the ink pool plate 200 and the ink feeding plate 300. An ink sucking port 800 used to feed ink from an ink tank (not shown) to the ink pool 201 is formed in a manner that it penetrates the ink feeding plate 300, the pressure chamber plate 400, and the vibrating plate 500.

Ordinarily, the piezoelectric elements 600 are bonded in advance with the vibrating plate 500. When these components are assembled, by using an alignment hole 900, as a reference, formed in each of the plates, the vibrating plate 500, pressure chamber plate 400, ink feeding plate 300, ink pool plate 200, and nozzle plate 100 are individually or collectively positioned and bonded to each other. An internal structure of the ink jet type printer head formed by the bonding/assembling work is partially taken and shown as a cross-sectional perspective in FIG. 7.

Next, operations of the expansion/contraction deformation in the piezoelectric element 600 and the vibrating plate 500 will be described by referring to FIGS. 7, 8, and 9.

As shown in FIG. 8, at a place corresponding to a position of each of pressure chambers 401, 401, . . . on the pressure chamber plate 400 existing on the vibrating plate 500 is stacked each of the piezoelectric elements 600 in a bonded manner. On a face and back of each of the piezoelectric elements 600 are formed an outer electrode 600*a* and an outer electrode 600*b* respectively. Each of the piezoelectric elements 600 is polarized, for example, in a direction shown by arrows "P" from the outer electrode 600*a* to the outer electrode 600*b*. (The direction in which the piezoelectric elements 600 are polarized may be reverse.)

The outer electrode 600*b* is directly and electrically connected to the vibrating plate 500 and is connected through the vibrating plate 500 serving as an electrode being common to each of the piezoelectric elements 600 to one pole of a driving power source 1000 of a pulse generator or a like.

Moreover, to the outer electrode 600*a* of each of the piezoelectric elements 600 is individually connected an electric signal line 601. Each of the piezoelectric elements 600 is connected through each of the electric signal lines 601 and each of ON/OFF controlling switch circuits 602 mounted to each of the piezoelectric elements 600 to the other pole of the driving power source 1000.

When a printing instruction is input, the ON/OFF controlling switch circuit 602 is turned ON and a voltage from the driving power source 1000 is applied to the piezoelectric elements 600. As a result, the piezoelectric elements 600 attempt to contract, by piezoelectric effects, in a direction of "e" as shown in FIG. 9. However, in the piezoelectric elements 600, an amount of distortion in a face being bonded to the vibrating plate 500, since it is limited by a load of the vibrating plate 500, is made smaller than that in the face on a reverse side. Due to an asymmetry in the amount of distortion, the bonded portion between the piezoelectric elements 600 and the vibrating plate 500 is deformed in a manner to be extruded in a direction of "f" as shown in FIG. 9. This causes a volume in the pressure chamber 401 to decrease and ink existing in the pressure chamber 401 to be pressurized.

FIGS. 10A, 10B, and 10C are cross-sectional views showing configurations of FIG. 7 taken along a line B—B to explain jetting operations of ink. FIG. 10A shows an initial state in which the ink pool 201, ink feeding port 301, pressure chamber 401, and nozzle 101 including its top end are filled with ink. When the ON/OFF controlling switch circuit 602 is turned ON in accordance with printing instruction, a voltage is produced in the piezoelectric element 600 and, as a result, the piezoelectric element 600 is deformed in a manner to be extruded in a direction "g" as shown in FIG. 10B. This causes ink in the pressure chamber 401 to be pressurized and the pressure in the pressure chamber 401 to be released to the nozzle 101 and the ink feeding port 301. As a result, ink is jetted on the nozzle 101. Then, when the ON/OFF controlling switch circuit 602 is turned OFF and electric charges in the piezoelectric element 600 are discharged, the piezoelectric element 600 is returned elastically to a direction "h" as shown in FIG. 10C. By this movement, an amount of ink being equivalent to an amount that has flowed out from the pressure chamber 401 by the jetting of ink is fed from the ink pool 201 through the ink feeding port 301 to the pressure chamber 401 and the pressure chamber 401 is again filled with the ink and a series of operations is terminated. In actual operations, the series of operations is performed at high speed so that printing is done.

However, the ink jet type printer head having such the configurations as described above has a problem. That is, if the piezoelectric element 600 is to be bonded to the vibrating plate 500 after the vibrating plate 500 and pressure chamber plate 400 have been bonded to each other in assembling process, warp occurs at a place corresponding to a position of the pressure chamber 401 on the vibrating plate 500 by a load produced when the piezoelectric element 600 is bonded to the vibrating plate 500, failing to impose a proper load between the piezoelectric element 600 and the vibrating plate 500 and making it difficult to reduce thickness of the bonded portion.

Moreover, the thickness of the bonded portion is made non-uniform, thus causing a detrimental effect that dispersion in characteristics of expansion/contraction deformation in the piezoelectric element 600 and the vibrating plate 500.

As a means to solve inconvenience occurring when the assembling is performed in such orders as described above, a method is proposed in which the piezoelectric element 600 is bonded to the vibrating plate 500 in a manner that the load is imposed from the pressure chamber 401 side on a place corresponding to the position of the pressure chamber 401 on the vibrating plate 500. However, if this method is to be employed, there is a need for a system that can impose the load on the place corresponding to the position of the pressure chamber 401 on the vibrating plate 500 from the reverse side, thus causing complicated devices to be used for the assembling or bonding processes.

On the other hand, another method is proposed in which a load is uniformly imposed on a bonded portion between the piezoelectric element 600 and the vibrating plate 500 by first having bonded the piezoelectric element 600 to the vibrating plate 500 and then by fixing the vibrating plate 500 having the piezoelectric element 600 to the pressure chamber plate 400 by applying pressure and then by stacking them to finally form the printer head.

However, this method also has a following problem. That is, when the vibrating plate 500 with the piezoelectric element 600 bonded is to be fixed to the pressure chamber plate 400 by applying pressure, a part of the vibrating plate 500 can not be fixed properly on a surface of the pressure chamber plate 400. Because there is a groove-like clearance among the piezoelectric elements 600 existing on the vibrating plate 500.

A part of the vibrating plate 500 where the groove-like clearance is formed can not be fixed properly on a surface of the pressure chamber plate 400, more particularly, on an upper face of a partitioning wall section 402 among the pressure chambers 401, 401, . . . , simply by applying force to an upper face of the piezoelectric element 600 to push the vibrating plate 500 on the pressure chamber plate 400.

To solve this problem, a pressing jig 1100 as shown in FIGS. 11A and 11B is used. The pressing jig 1100 is so configured that a concave portion having a depth being slightly deeper than thickness of the piezoelectric element 600 is formed at a place corresponding to the piezoelectric element 600.

The vibrating plate 500, by fitting convex portions formed between the concave portions into the groove-like clearances among the piezoelectric elements 600 to directly press the vibrating plate 500, is fixed to an upper face of the partitioning wall section 402 among the pressure chambers 401, 401, . . . .

In order to use the pressing jig 1100 properly, high working accuracy of the pressing jig 1100 or alignment accuracy at a time of using it is required, thus causing a detrimental effect that the assembly process is made complicated. Moreover, since the thickness of the concave portion of the pressing jig 1100 is larger than that of the piezoelectric element 600, the pressure chamber plate 400 (that is, surface area except through hole of pressure chambers 401, 401 in the pressure chamber plate 400) cannot be fixed satisfactorily to the vibrating plate 500 at a place of an electrode taking-out section 600*c* mounted on the piezoelectric element 600, that is, at a part of the piezoelectric element 600 projecting outside of the pressure chamber 401, as shown in FIG. 11B, causing a likelihood of leak of ink from the bonded portion between the pressure chamber plate 400 and the vibrating plate 500 or peeling-off of the bonded portion.

Also, since a load on the piezoelectric element 600 imposed when the piezoelectric element 600 is individually separated by nachining is large, there is a high likelihood of the occurrence of burrs or cracks on the piezoelectric element 600. To solve these inconveniences, measures of making working speed lower and of making the piezoelectric element 600 thicker, and measures other than use of machining such a measure as disclosed in Japanese Patent Application Laid-open No. Hei 2-92644 in which a piezoelectric element is separated by an etching process are necessary, which present a big problem in production and commercialization.

Furthermore, such a method as disclosed in Japanese Patent Application Laid-open No. Hei 1-269546 is proposed in which a piezoelectric element is driven in a manner that a piezoelectric element is not separated individually and each of piezoelectric elements is operated independently for each electrode by printing an electrode pattern on a piece of the piezoelectric element. However, this method also presents a problem. That is, since each of the piezoelectric elements is integrated, which has the same thickness, the piezoelectric elements each being driven by a different electrode and existing in each of adjacent regions interfere with each other, causing an individual operation of each of the piezoelectric elements to be unstable, that is, causing jetting operations of ink in each of pressure chambers to be unstable.

SUMMARY OF THE INVENTION

In view of the above, it is an object of the present invention to provide an ink jet type printer head in which a pressure chamber plate, a vibrating plate, and a piezoelectric element can be properly stacked and bonded in its assembly without using a complicated pressing jig and in which the piezoelectric element can be properly operated for each of pressure chambers without interference.

According to a first aspect of the present invention, there is provided an ink jet type printer head including:

- a plurality of pressure chambers each communicating with a nozzle and an ink pool;
- a pressure chamber plate on which the plurality of pressure chambers are formed by boring holes;
- piezoelectric elements which are fixed through a vibrating plate at places corresponding to the plurality of pressure chambers formed on the pressure chamber plate; and
- wherein ink is jetted from the nozzle and ink is fed from the ink pool by changing a volume of each of the pressure chambers in accordance with expansion/contraction deformation of each of the piezoelectric elements and the vibrating plate and wherein grooves going around along corresponding positions inside a space section of each of the pressure chambers are formed on a surface of one piece of a piezoelectric element plate containing places corresponding to all the pressure chambers and a part of the piezoelectric element plate partitioned by the grooves acts as the piezoelectric element for each of the pressure chambers.

In the foregoing, a preferable mode is one wherein the grooves going around along inside portions of the space sections of the pressure chambers are provided by forming a plurality of straight-line like through-holes along positions corresponding to straight line sections and circular arc sections inside the space sections of the pressure chambers.

Also, a preferable mode is one wherein one piece of the piezoelectric element plate is made up of a sheet-like piezoelectric element main body and an outer electrode body covering a piezoelectric element main body and wherein the grooves penetrate at least the outer electrode bodies and are formed in a manner that cutting is performed up to the piezoelectric element main body.

Also, a preferable mode is one wherein the grooves are formed by an etching method.

Also, a preferable mode is one wherein the grooves are formed by a sandblasting method.

Also, a preferable mode is one wherein the grooves are formed by a dicing method.

Also, a preferable mode is one wherein the grooves are formed by a wire electric discharge machining method.

Furthermore, a preferable mode is one wherein a width of the groove accounts for 5% to 20% of that of the pressure chamber.

With the above configurations, the ink jet type printer head is so configured that the grooves going around along the corresponding position inside the space portion of each of the pressure chambers are formed on the surface of one piece of the piezoelectric element plate to partition the piezoelectric element plate and each portion of the piezoelectric element plate partitioned by these grooves acts as the piezoelectric element for each of the pressure chambers and, therefore, excessive clearance portions are not formed in a periphery of the piezoelectric element and simply by pressing the surface of the piezoelectric element in a stacking and assembling process of the piezoelectric element, vibrating plate, and pressure chamber plate, the vibrating plate can be fixed firmly not only to partitioning wall sections formed among the pressure chambers but also to the pressure chamber plate, thus solving problems of a leak of ink caused by defective bond and/or a peeling-off of members.

With another configuration, the piezoelectric elements are partitioned by the groove formed on the surface of the piezoelectric element plate and therefore an influence of adjacent piezoelectric elements on the piezoelectric element can be limited, thus enabling each of the piezoelectric element plates to be reliably operated as an independent piezoelectric element.

With another configuration, the grooves used to partition the piezoelectric element from other portions by going around the piezoelectric element plate and therefore not only ordinary groove working methods including etching and sandblasting but also working methods such as dicing or wire electric discharge machining in which forming of the groove at a specified portion with parts being left at both ends is impossible or the working method in which the change of forming direction of the groove in progress is impossible can be used, thus serving to improve the working accuracy and working speed and preventing the occurrence of burrs and cracks and enabling selection of the best suitable working method.

With another configuration, the piezoelectric element plate is made up of the sheet-like piezoelectric element main body and the outer electrode body covering the surface of the piezoelectric main body and therefore the separation of mechanical operations for each of the piezoelectric elements and the production of the outer electrode for each of the piezoelectric elements can be achieved simultaneously by simple groove working, thus allowing the manufacturing process to be simplified.

BRIEF DESCRIPTION OF THE DRAWINGS

The above and other objects, advantages, and features of the present invention will be more apparent from the following description taken in conjunction with the accompanying drawings in which:

FIG. 5 is a cross-sectional perspective view illustrating an example of the ink jet type printer head having a piezoelectric element plate in which a groove is formed by using dicing, wire electric discharge machining or a like;

DETAILED DESCRIPTION OF THE PREFERRED EMBODIMENTS

Best modes of carrying out the present invention will be described in further detail using various embodiments with reference to the accompanying drawings.

Embodiment

Figure 1:
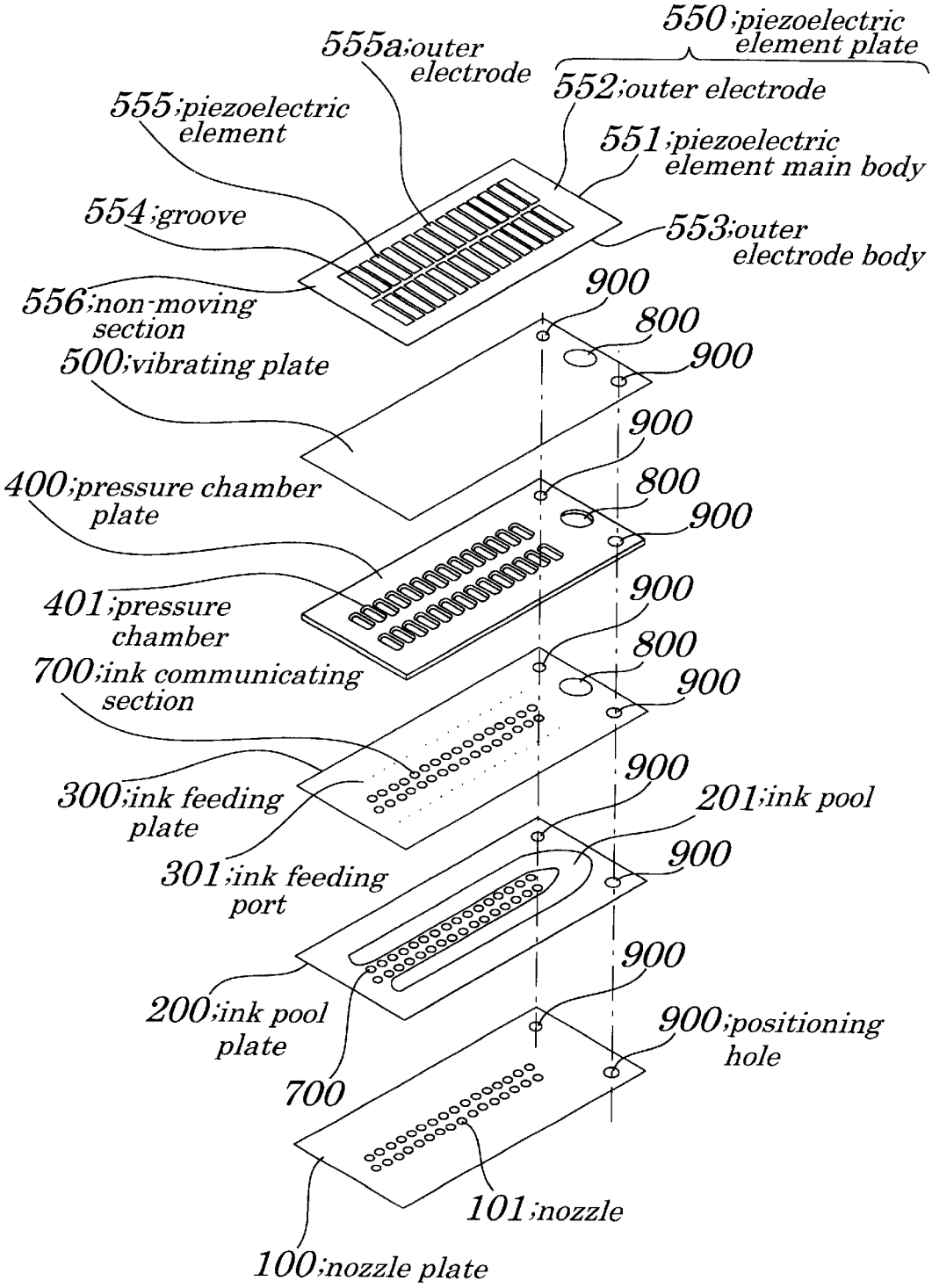
FIG. 1 is a diagram showing configurations of components making up an ink jet type printer head having a piezoelectric element plate with a groove formed by using an etching method, sandblasting or a like, according to an embodiment of the present invention.

FIG. 1 is a diagram showing configurations of components making up an ink jet type printer head having a piezoelectric element plate with a groove formed by using an etching method, sandblasting or a like, according to an embodiment of the present invention.

Figure 6:
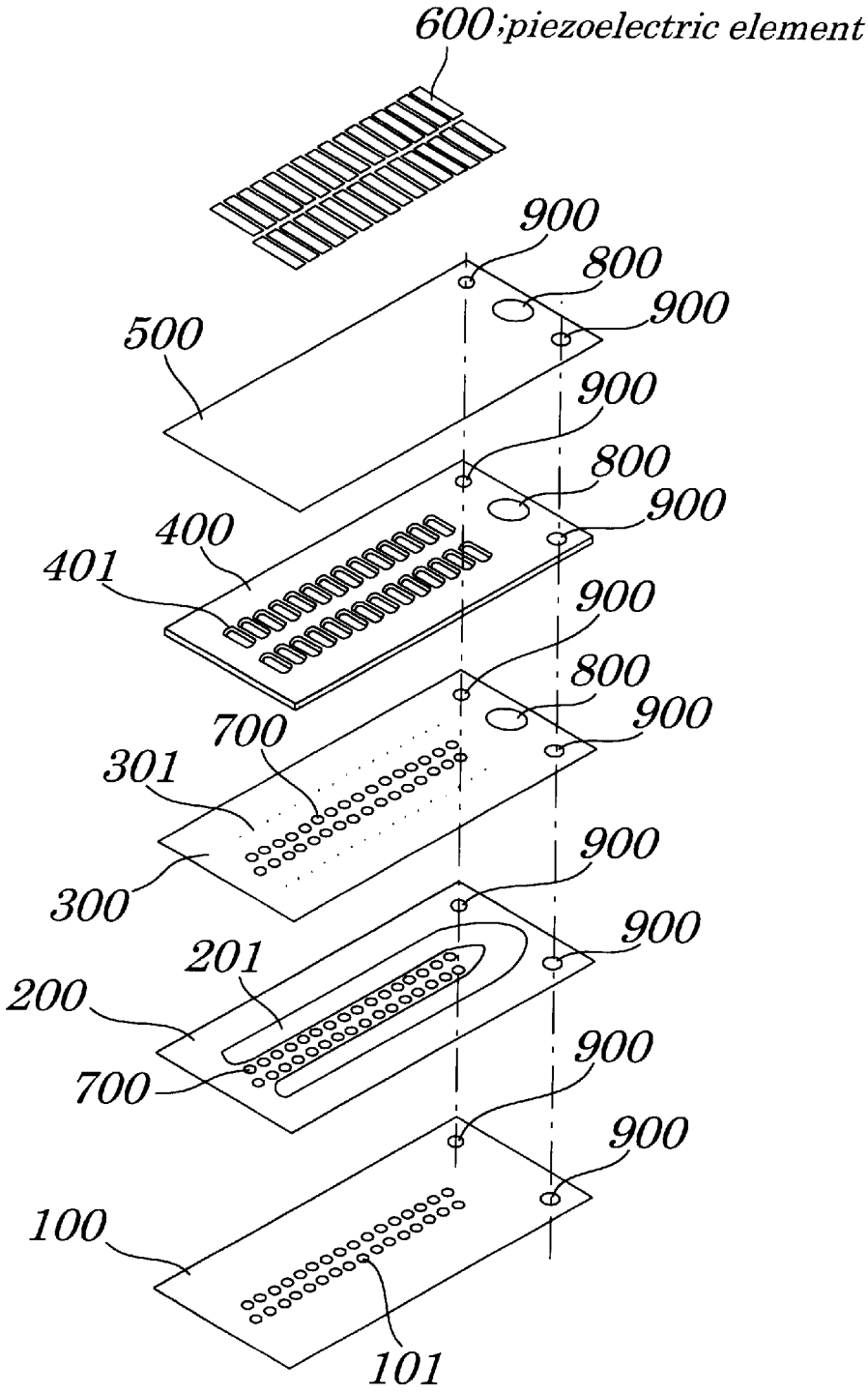
FIG.6 (PRIOR ART)
FIG. 6 is a conceptual diagram showing assembly of a conventional ink jet type printer head.
Figure 7:
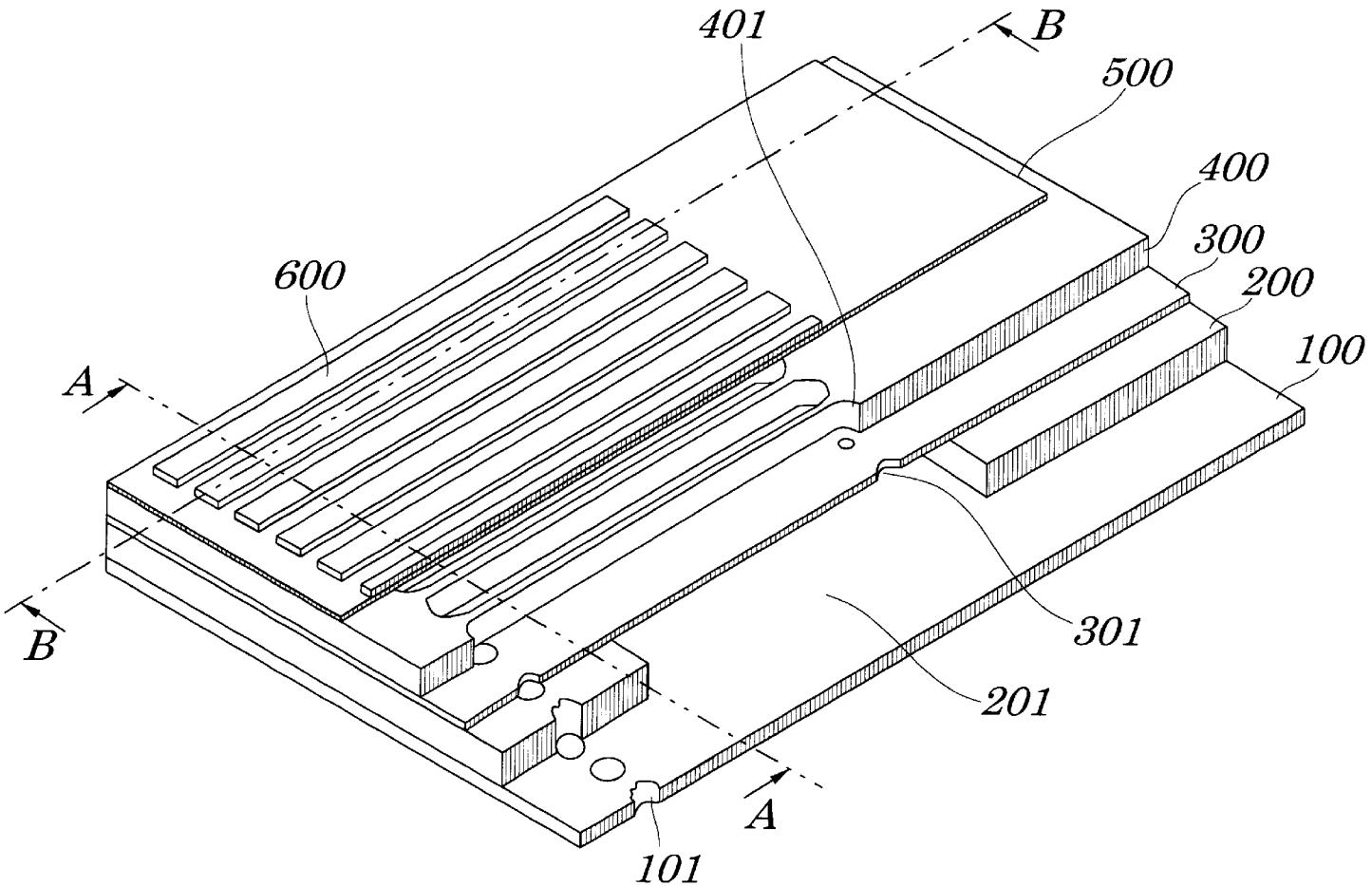
FIG. 7 (PRIOR ART)
FIG. 7 is a cross-sectional perspective view of parts partially taken from the conventional ink jet type printer head.

In the ink jet type printer head shown in FIG. 1, configurations of a nozzle plate 100, an ink pool plate 200, an ink feeding plate 300, a pressure chamber plate 400, and a vibrating plate 500 the same as in a case of the conventional example shown in FIG. 6 and therefore descriptions of them are omitted and configurations of a piezoelectric element plate 550 will be explained in detail.

The piezoelectric element plate 550 includes a sheet-like piezoelectric element main body 551 having an area that can simultaneously cover all pressure chambers 401 formed by boring holes on the pressure chamber plate 400, an outer electrode body 552 covering entire surfaces of the piezoelectric element main body 551 and an outer electrode body 553 covering entire backs of the piezoelectric element main body 551.

Figure 8:
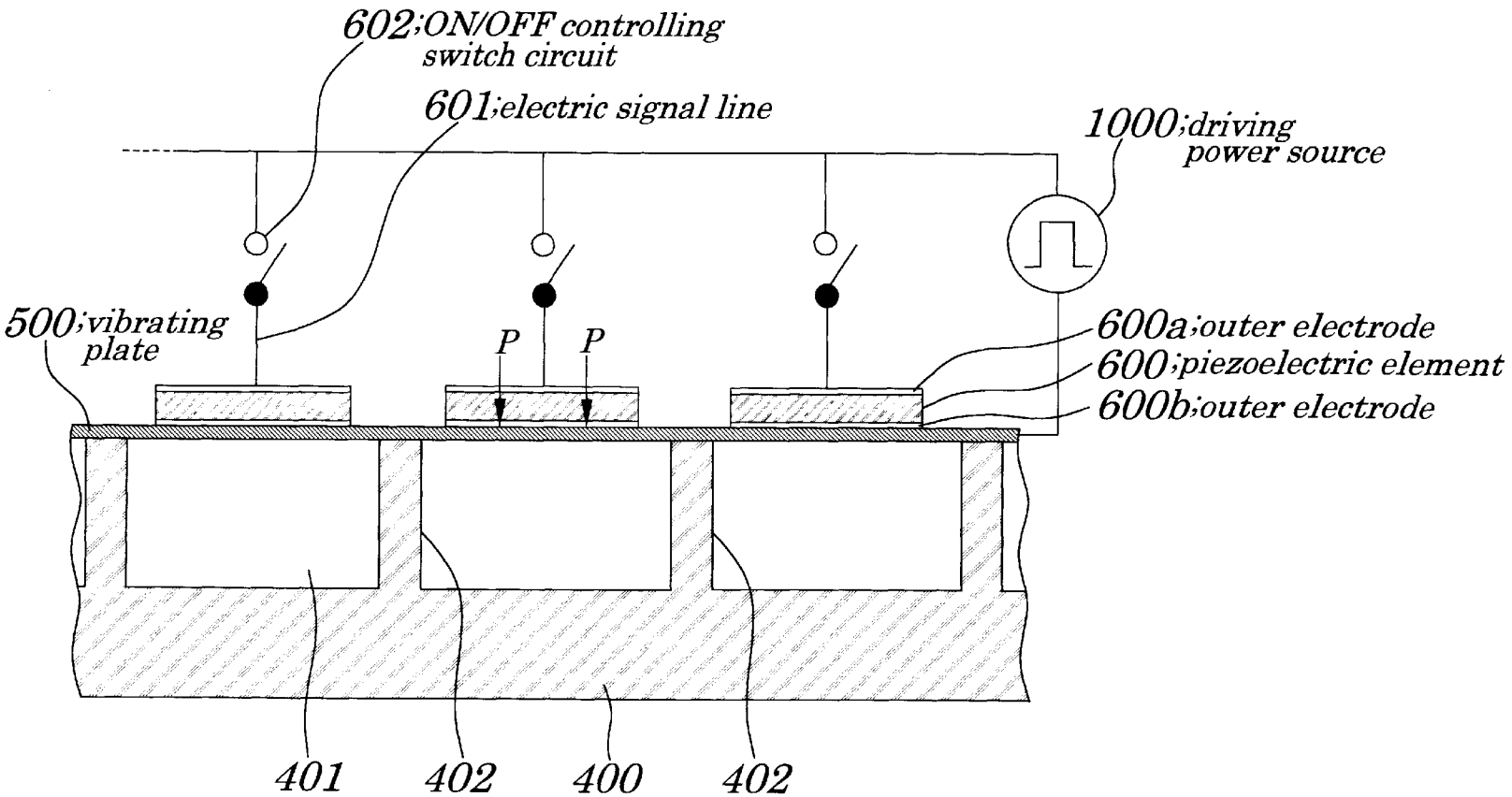
FIG.8 (PRIOR ART)
FIG. 8 is a cross-sectional view showing configurations of FIG. 7, in an initial operating state, taken along the line A—A.

Though cross-sectional configurations of the piezoelectric element main body 551 are not described in detail, relations of the outer electrode bodies 552 and 553 to the piezoelectric element main body 551 are same as that of outer electrodes 600*a* and 600*b* to a piezoelectric element 600 as shown in FIG. 8.

Grooves 554 are formed by being engraved on a surface of the piezoelectric element plate 550 in a manner that the grooves 554 go around an inside of a place corresponding to a space section of each of the pressure chambers 401 formed by boring holes in the pressure chamber plate 400 at a depth at which the grooves 554 penetrate the outer electrode body 552 and at a depth at which the grooves 554 do not cut completely the piezoelectric element main body 551. Each portion of the piezoelectric element plate 550 partitioned by the grooves 554 acts as a piezoelectric element 555 for each of the pressure chambers 401.

Each of the piezoelectric elements 555 is provided, on its upper face, with the outer electrode body 552 electrically insulated from the outer electrode body 552 of other portions, that is, with an outer electrode 555*a* for each of the piezoelectric elements 555. Also, on its lower face, with the outer electrode body 553 used commonly by all piezoelectric elements in the same manner as in the case where the groove 554 has been formed.

The outer electrode 555*a* for each of the piezoelectric elements 555 is connected through an electric signal line and an ON/OFF controlling switch circuit to one pole of a driving power source, as in the case of the conventional outer electrode 600*a* described by referring to FIG. 8, while the outer electrode body 553 also serving as the common electrode is connected through the vibrating plate 500 to the other pole of the driving power source, as in the case of the conventional outer electrode 600*b* described by referring to FIG. 8.

Moreover, since no power is supplied, under all conditions, to other portions not partitioned by the grooves 554, of the outer electrode body 552 in the piezoelectric element plate 550, these portions act simply as a non-moving section 556 having a same thickness as that of the piezoelectric elements 555.

Figure 2:
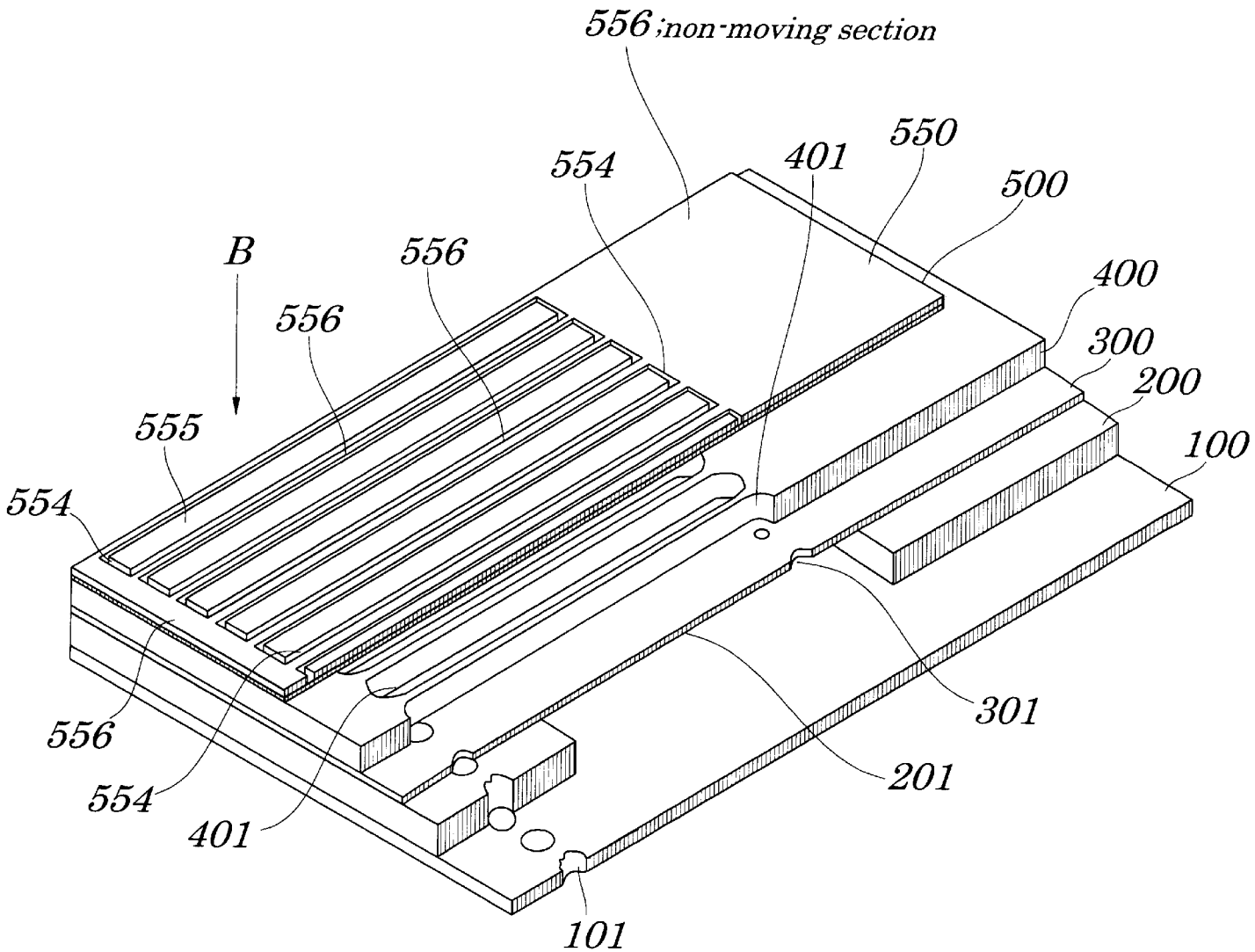
FIG. 2 is a cross-sectional perspective view of parts partially taken from the ink jet type printer head according to the embodiment of the present invention.

FIG. 2 is a cross-sectional perspective view of parts partially taken from the ink jet type printer head that has been assembled according to the embodiment of the present invention. The piezoelectric elements 555 are bonded to the vibrating plate 500 in a manner that the piezoelectric elements 555 and a plurality of pressure chambers 401 formed by boring holes in the pressure chamber plate 400 overlap.

Figure 3:
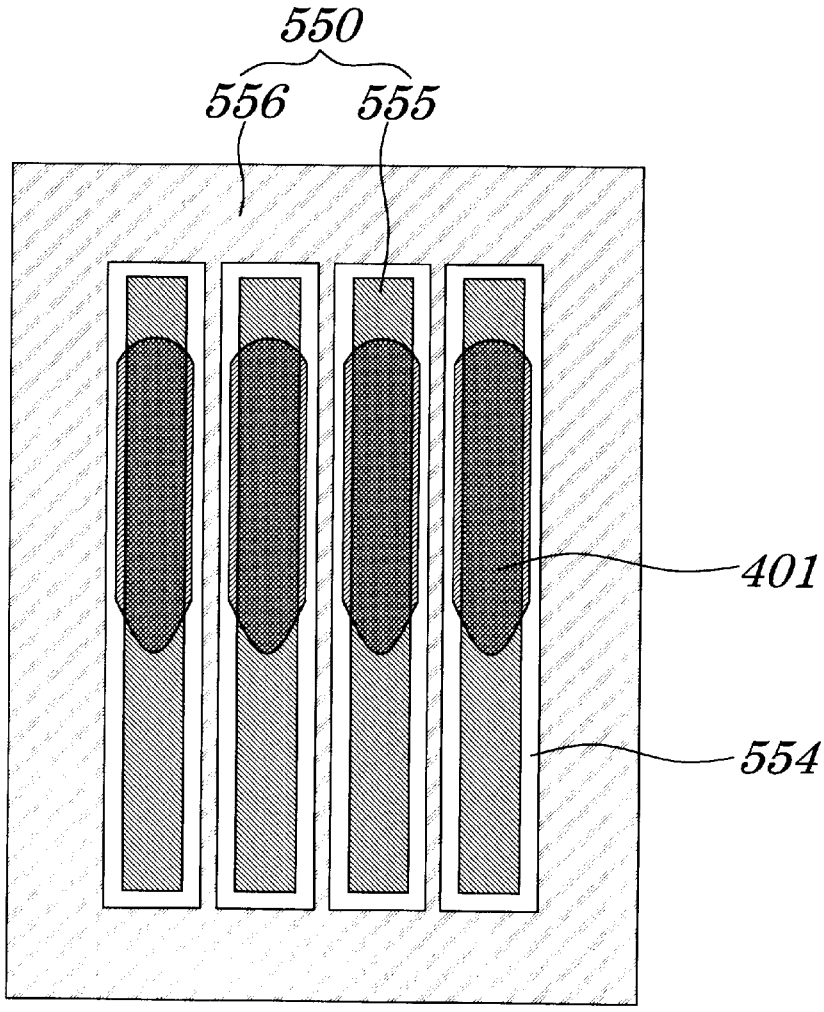
FIG. 3 is a perspective view illustrating a positional relation of a pressure chamber to each of piezoelectric elements seen from a direction of arrow B of FIG. 2.

FIG. 3 is a perspective view illustrating a positional relation of each of the pressure chamber 401 to each of piezoelectric elements 555 seen from a direction of an arrow B of FIG. 2. The piezoelectric element plate 550 is divided by the groove 554 into the non-moving section 556 and the piezoelectric element 555 for each pressure chamber 401 and each of the piezoelectric elements 555 is mounted in a manner that the piezoelectric element 555 and the pressure chamber 401 overlap and the non-moving section 556 is mounted in a manner that the non-moving section 556 and the pressure chamber 401 do not overlap.

Next, assembling operations of the ink jet type printer head having configurations of the embodiment will be described. One example is described in which the piezoelectric element plate 550 is bonded, in advance, with the vibrating plate 500 and then the vibrating plate 500 is bonded to the pressure chamber plate 400. However, the same effect can be obtained by a method in which the piezoelectric element plate 550 is bonded to the vibrating plate 500, with the pressure chamber plate 400 bonded to the vibrating plate 500 in advance.

Figure 4A:
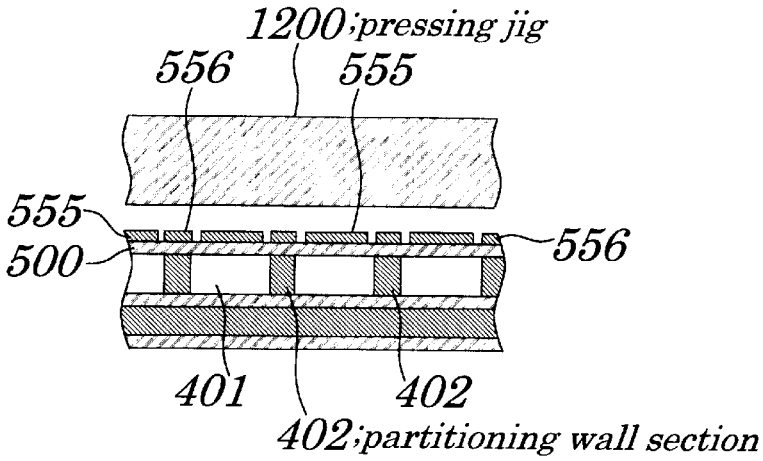
FIG. 4A is a cross-sectional view illustrating a pressing jig to be used when a vibrating plate having a piezoelectric element plate is bonded to a pressure chamber plate and a method of using the pressing jig, according to the embodiment of the present invention.
Figure 4B:
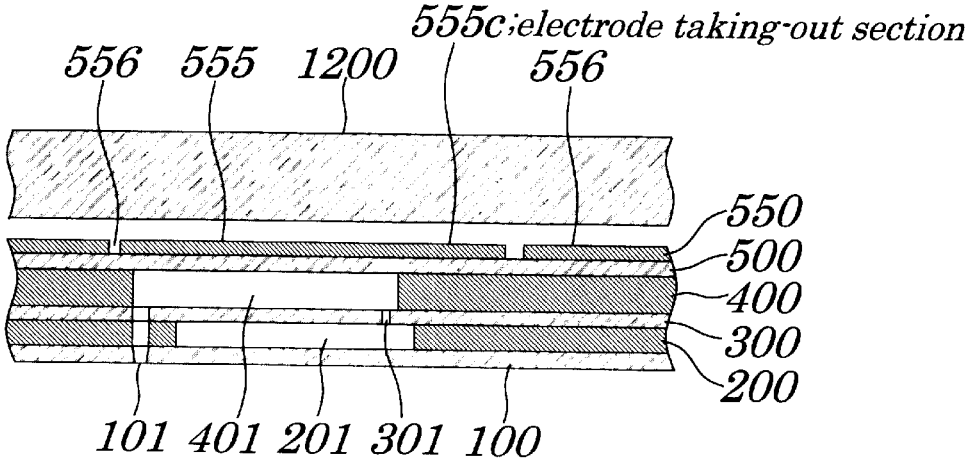
FIG. 4B is also a cross-sectional view illustrating the pressing jig to be used when the vibrating plate having the piezoelectric element plate is bonded to the pressure chamber plate and the method of using the pressing jig, according to the embodiment of the present invention.

FIGS. 4A and 4B are cross-sectional views illustrating a flat pressing jig 1200 to be used when the vibrating plate 500 having the piezoelectric element plate 550 is bonded to a pressure chamber plate 400 and a method of using the flat pressing jig 1200.

As shown in FIGS. 4A and 4B, when the vibrating plate 500 on which the piezoelectric element plate 550 having the piezoelectric element 555 and the non-moving section 556 have been mounted is bonded to the pressure chamber plate 400, simply by pressing an upper face of the piezoelectric element plate 550 using the flat pressing jig 1200, the vibrating plate 500 can be firmly pressed on the partitioning wall section 402 formed between the pressure chamber 401 in the pressure chamber plate 400. By doing this, as shown in FIG. 4A, the vibrating plate 500 is properly pressed, through the non-moving sections 556 existing between the adjacent piezoelectric elements 555, on the partitioning wall section 402 existing among the pressure chambers 401. As described above, the thickness of the piezoelectric element 555 and of the non-moving section 556 is completely the same.

Moreover, at a proper place of an electrode taking-out section 555*c* in the piezoelectric element 555, the vibrating plate 500 can be pressed firmly to the pressure chamber plate 400. This can be achieved because the vibrating plate 500 is directly pressed to the pressure chamber plate 400 ((that is, surface area except through hole of pressure chambers 401, 401 in the pressure chamber plate 400) through the electrode taking-out section 555*c* having the same thickness as that of the non-moving section 556.

This enables the leak of ink occurring among the pressure chambers 401 to be prevented by employing a simple assembly process using a flat pressing jig 1200. Also, this can solve the problem of the peeling-off of members caused by defective bonding. Furthermore, this can prevent the leak of ink occurring at a bonding portion between the vibrating plate 500 and the pressure chamber plate 400 on the periphery of the electrode taking-out section 555*c*.

Figure 9:
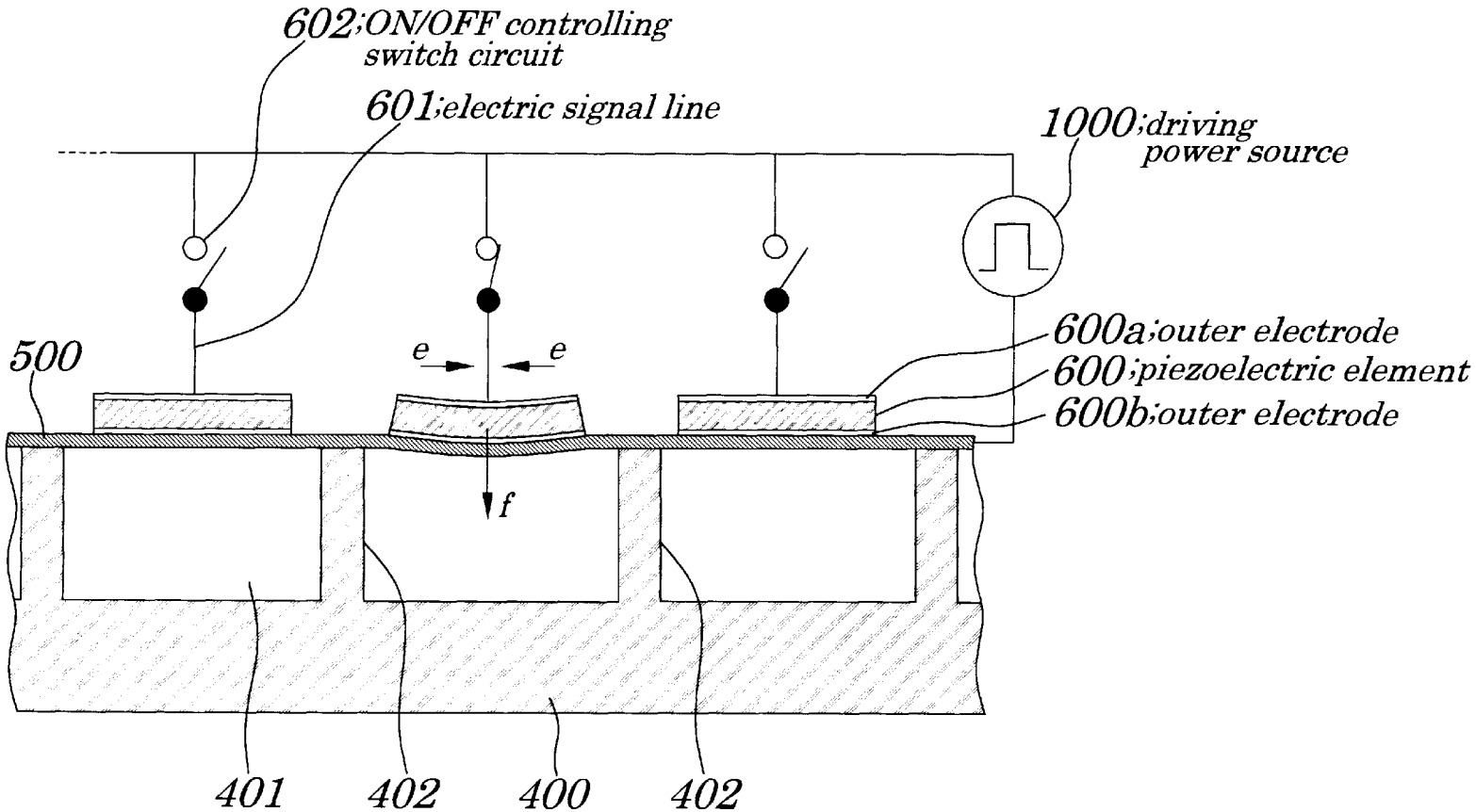
FIG. 9 (PRIOR ART)
FIG. 9 is a cross-sectional view showing configurations of FIG. 7, in an expanded/contracted and deformed state, taken along the line A—A.
Figure 10A:
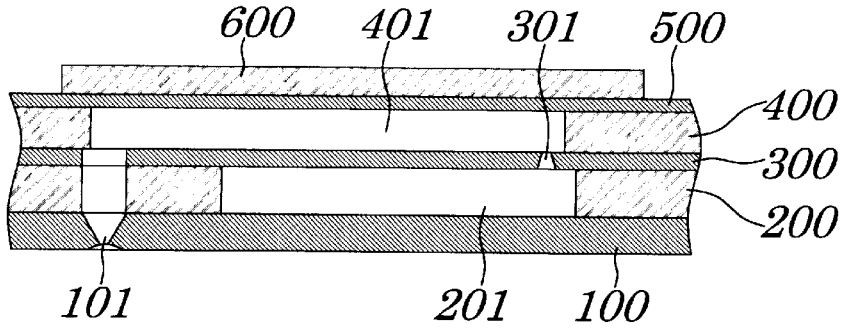
FIG. 10A (PRIOR ART)
FIG. 10A is a cross-sectional view showing configurations of FIG. 7, in the initial operating state, taken along the line B—B.
Figure 10B:
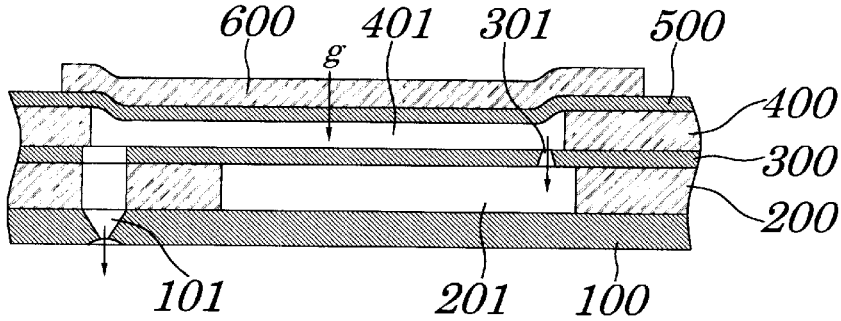
FIG. 10B (PRIOR ART)
FIG. 10B is a cross-sectional view showing configurations of FIG. 7, in the expanded/contracted and deformed state, taken along the line B—B.
Figure 10C:
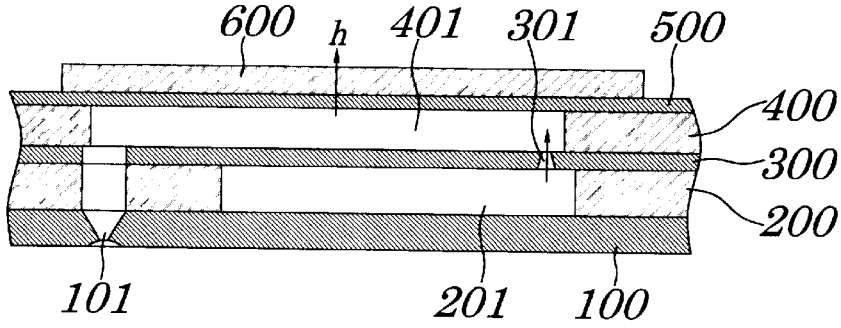
FIG. 10C (PRIOR ART)
FIG. 10C is a cross-sectional view showing configurations of FIG. 7, occurring when the expanded/contracted and deformed state is returned to its initial state, taken along the line B—B.
Figure 11A:
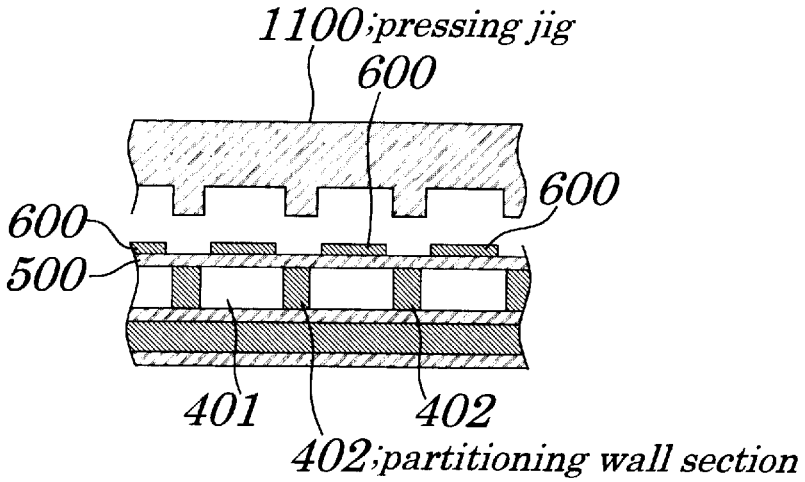
FIG. 11A (PRIOR ART)
FIG. 11A is a cross-sectional view showing operational principles of a pressing jig employed in the conventional assembly process.
Figure 11B:
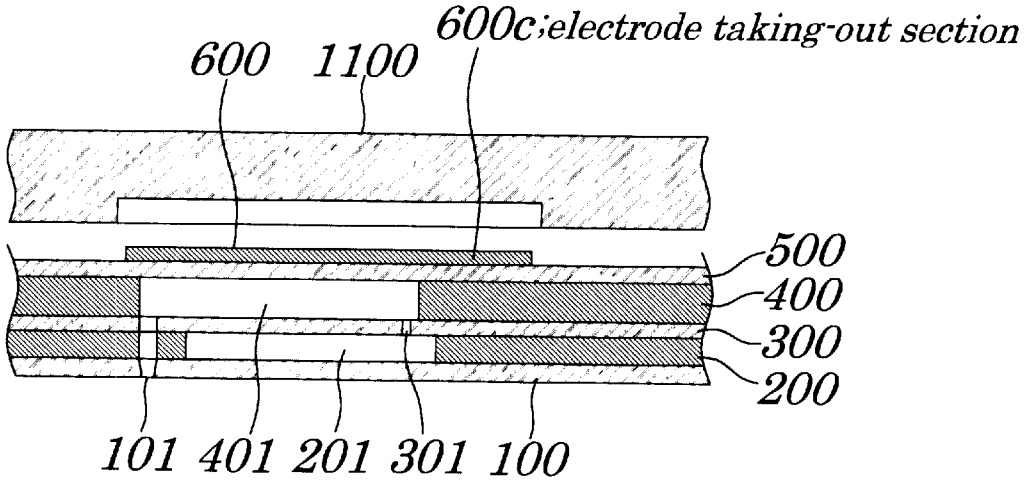
FIG. 11B (PRIOR ART)
FIG. 11B is also a cross-sectional view showing operational principles of the pressing jig employed in the conventional assembly process.

Operations at a time of actually applying a voltage and of driving each of the piezoelectric elements 555 are the same as in the conventional technology described by referring to FIGS. 8 and 9. Unlike in the case of the technology disclosed in Japanese Patent Application Laid-open No. Hei 1-269546 or the like in which only an electrode pattern is divided and each of the piezoelectric elements each having the same thickness is operated independently, in the embodiment of the present invention, there is no interference with operations of other piezoelectric elements 555 by influences of operations of the piezoelectric elements 555 in adjacent regions. This is achieved because degree of freedom of the expansion/contraction deformation of each of the piezoelectric elements 555 is improved not only by dividing the electrode pattern but also by inserting the groove 554 into a part of the piezoelectric element main body 551 making up the main portion of the piezoelectric element plate 550.

Figure 5:
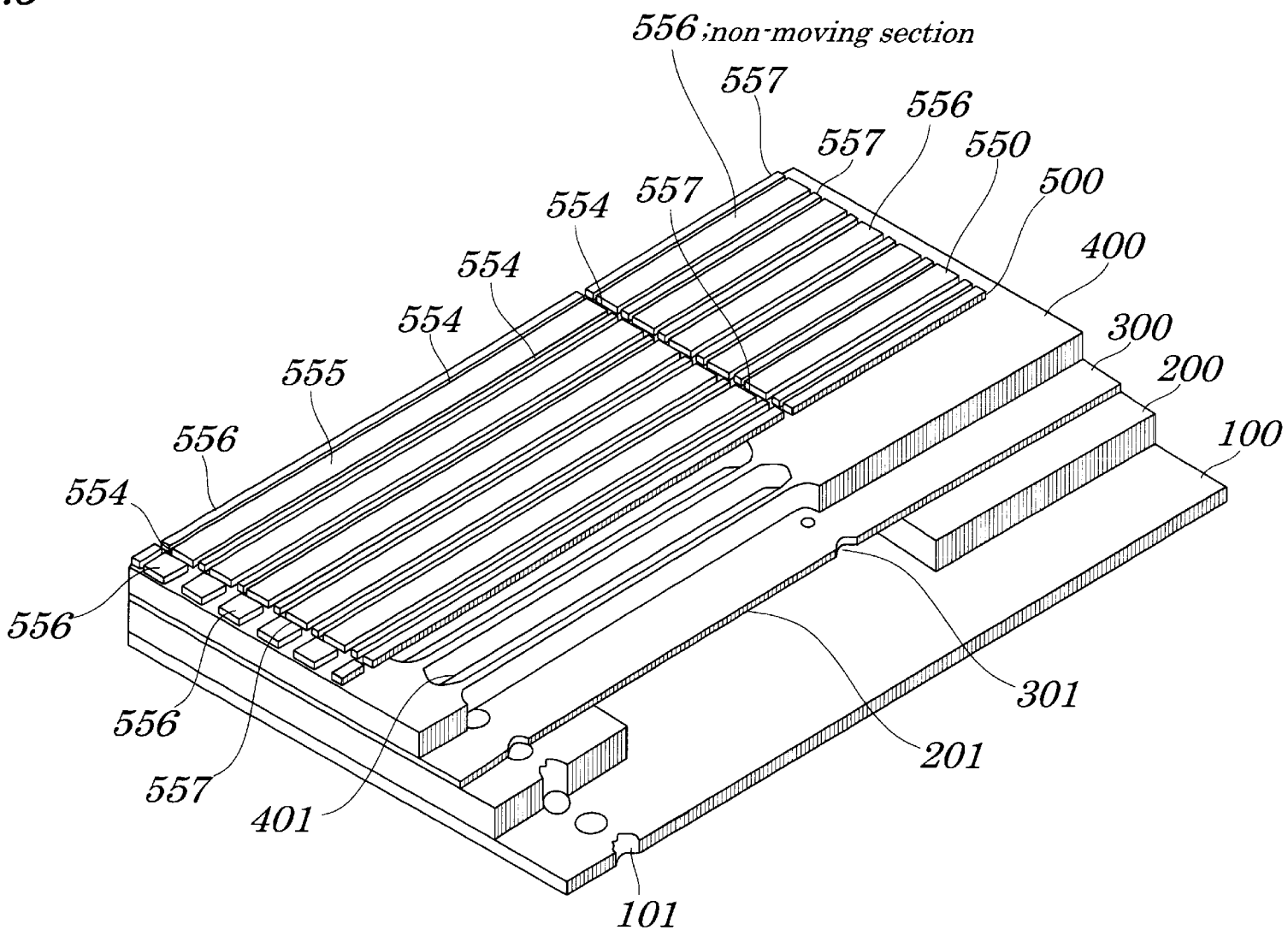

FIG. 5 is a cross-sectional perspective view illustrating an example of the ink jet type printer head having the piezoelectric element plate 550 in which grooves are formed by using dicing, wire electric discharge machining or a like. The configurations of the ink jet type printer head shown in FIG. 5 differ from those shown in FIG. 2 in that, instead of the groove 554 used to partition the piezoelectric elements 555 by going around them, a plurality of straight-line like through-grooves 557 is formed which penetrates vertically and horizontally the piezoelectric element plate 550.

Thus, the groove 554 going around each of the piezoelectric elements 555 is formed by combining such straight-line through-grooves 557. It is therefore possible to employ the dicing method to form the groove 554, the wire electric discharge machining method or a like, with which it is difficult to form the groove at a specified portion with both ends being left after being or to change a direction of forming the groove in progress.

The dicing method being one type of cut working has an advantage in terms of its working speed and working accuracy and the non-contact wire electric discharge machining method providing discharging intervals, since it does not do dynamic damage to the work, is effective in preventing the occurrence of burrs or cracks in the piezoelectric elements 555.

Thus, by forming the groove 554 going around each of the piezoelectric elements 555 by combining the straight-line through-groove 557 as described above, it is made possible to employ not only limited working methods such as the etching, sandblasting or the like that are conventionally used but also other working methods such as the wire electric discharge machining method not suitable to leave an undercut or the dicing method in which a change of the forming direction of a groove is difficult, thus providing many merits to the assembling process of the ink jet type printer head.

In the embodiment of the present invention, it is preferable that a width of the groove 554 accounts for about 5% to 20% of that of the pressure chamber 401.

It is known from experiment or numerical analysis that, in an actuator in a uni-morph mode as shown in the embodiment of the present invention, efficiency of the expansion/contraction deformation becomes maximum when the width of the piezoelectric elements 555 accounts for 80% to 90% of that of the pressure chamber 401. However, if the width of the piezoelectric elements 555 accounts for more than 90% of that of the pressure chamber 401, the efficiency extremely drops. Therefore, it is practical that the numerical design is so made, with considerations given to a margin of working accuracy, that the width of the piezoelectric elements 555 accounts for about 70% to 80% of that of the pressure chamber 401 (refer to "New MACH type ink jet head" published at First Study Meeting in 1996 by Imaging Society of Japan).

In the above embodiment, since each of the piezoelectric element 555 is mounted by forming the groove 554 on the piezoelectric element plate 550 along a corresponding position inside the space portion of each of the pressure chambers 401, the width of the groove 554 required to cause the width of the piezoelectric element 555 to account for 70% to 80% of that of the pressure chamber 401 is within (100–70)%/2 to (100–80)%/2, that is, within 10% to 15% of the width of the pressure chamber 401.

However, in actual operations, when considerations are given to alignment accuracy between the piezoelectric element plate 550 having the piezoelectric element 555 or alignment accuracy between the vibrating plate 500 and the pressure chamber plate 400, the width of the groove 554 required for forming the proper piezoelectric element 555 preferably accounts for 5% to 20% of that of the pressure chamber 401.

As described above, in the ink jet type printer head of the embodiment so configured that the non-moving portion 556 is interposed among piezoelectric elements 555, since the width of the groove 554 may be made smaller when compared with the conventional case (for example, as shown in FIG. 8) in which each of the piezoelectric elements 555 is completely separated, the load imposed on the piezoelectric elements 555 during the machining of the groove 554 is reduced and breakage of the piezoelectric elements 555 can be prevented.

When the vibrating plate 500 having the piezoelectric element 555 and non-moving section 556 is bonded to the pressure chamber plate 400, since the non-moving section 556 exists among the piezoelectric elements 555, simply by pressing on the upper face of the piezoelectric element plate 550 using the flat pressing jig 1200, the vibrating plate 500 can be firmly pressed to the partitioning wall section 402 formed between the pressure chambers 401 of the pressure chamber plate 400 and, further, since, at a corresponding place of an electrode taking-out section 555*c* of the piezoelectric element 555, the vibrating plate 500 can be pressed firmly to the pressure chamber plate 400 (that is, surface area except through hole of pressure chambers 401, 401 in the pressure chamber plate 400), problems of a leak of ink occurring among the pressure chambers 401 or peeling-off of members caused by defective bonding can be completely solved.

It is apparent that the present invention is not limited to the above embodiments but may be changed and modified without departing from the scope and spirit of the invention.

What is claimed is:

1. An ink jet print head comprising:

a pressure chamber plate having a plurality of pressure chambers;

a piezoelectric element plate having a plurality of piezoelectric elements each of which deform upon the application of a voltage thereto and at least one non-moving section which does not deform upon the application of the voltage to any of the plurality of piezoelectric elements, each of the plurality of piezoelectric elements being positioned so as to correspond to a respective pressure chamber of the plurality of pressure chambers, wherein the plurality of piezoelectric elements and the at least one non-moving section are separated by grooves which are formed on a surface of the piezoelectric element plate so as to surround and define each of the plurality of piezoelectric elements; and a vibrating plate sandwiched between the pressure chamber plate and the piezoelectric element plate so as to cover the plurality of pressure chambers, wherein the plurality of piezoelectric elements and the at least one non-moving section have substantially the same thickness.

2. The ink jet print head according to claim 1, wherein the groove within the upper surface of the vibrating plate does not extend completely through the vibrating plate.

3. The ink jet print head according to claim 1, wherein the plurality of piezoelectric elements and the at least one non-moving section have exactly the same thickness measured from the lower surface to the upper surface of the of the vibrating plate.

4. The ink jet print head according to claim 1, wherein the plurality of piezoelectric elements and the at least one non-moving section are formed in a piezoelectric element plate which is bonded to the vibrating plate.

5. The ink jet print head according to claim 4, wherein each of the plurality of piezoelectric elements have an upper electrode on an upper face thereof and a lower electrode on a lower face thereof.

6. The ink jet print head according to claim 4, wherein the piezoelectric element plate includes a piezoelectric element main body, a first outer electrode covering the entire upper surface of the main body and a second outer electrode covering the entire lower surface of the main body, and the grooves extend through the first outer electrode and into the main body.

7. The ink jet print head according to claim 1, wherein each of the plurality of piezoelectric elements are positioned so as to overlap their respective pressure chamber.

8. The ink jet print head according to claim 7, wherein the at least one non-moving section is positioned so as to not overlap any of the plurality of pressure chambers.

9. The ink jet print head according to claim 7, wherein a width of the grooves is about 5% to about 20% of a width of one of the plurality of pressure chambers.

10. A method of manufacturing an ink jet print head, the method comprising:

forming grooves in a surface of a piezoelectric element plate so as to define a plurality of plurality of piezoelectric elements each of which deform upon application of a voltage thereto and at least one non-moving section which does not deform upon the application of the voltage to any of the plurality of piezoelectric elements, wherein the grooves surround the plurality of piezoelectric elements and separate the plurality of piezoelectric elements from the at least one non-moving section;

bonding the piezoelectric element plate to a vibrating plate after the grooves are formed in the surface of the piezoelectric element plate; and bonding the vibrating plate to a pressure chamber plate having a plurality of pressure chambers, wherein each of the plurality of piezoelectric elements are positioned so as to correspond to a respective pressure chamber of the plurality of pressure chambers, and the plurality of piezoelectric elements and the non-moving section have substantially the same thickness.

11. The method of manufacturing an ink jet print head according to claim 10, wherein the grooves are formed so as to not extend completely through the piezoelectric element plate.

12. The method of manufacturing an ink jet print head according to claim 10, wherein the plurality of piezoelectric elements are positioned so as to overlap their respective pressure chamber and the non-moving section is positioned so as to not overlap the plurality of pressure chambers.

13. The method of manufacturing an ink jet print head according to claim 10, wherein the piezoelectric element plate and the vibrating plate are bonded together using a flat pressing jig.

14. The method of manufacturing an ink jet print head according to claim 10, wherein the grooves are formed in the piezoelectric plate after the piezoelectric plate is bonded to the vibrating plate.

15. The method of manufacturing an ink jet print head according to claim 10, wherein the grooves are formed in the piezoelectric plate before the piezoelectric plate is bonded to the vibrating plate.

16. The method of manufacturing an ink jet print head according to claim 10, wherein the grooves are formed by an etching method.

17. The method of manufacturing an ink jet print head according to claim 10, wherein the grooves are formed by a sandblasting method.

18. The method of manufacturing an ink jet print head according to claim 10, wherein the grooves are formed by a dicing method.

19. The method of manufacturing an ink jet print head according to claim 10, wherein the grooves are formed by wire electric discharge machining.

20. The method of manufacturing an ink jet print head according to claim 10, wherein the grooves are formed to have a width of about 5% to about 20% of a width of one of the plurality of pressure chambers.

* * * * *